United States Patent [19]

Gozlan

[11] 4,299,028

[45] Nov. 10, 1981

[54] METHOD FOR CONNECTING SUBSTRATES

[75] Inventor: Gilles R. Gozlan, Drancy, France

[73] Assignee: Raychem Pontoise S.A., St. Ouen l'Aumone, France

[21] Appl. No.: 18,412

[22] Filed: Mar. 7, 1979

Related U.S. Application Data

[63] Continuation of Ser. No. 741,371, Nov. 12, 1976, abandoned.

[30] Foreign Application Priority Data

May 10, 1976 [GB] United Kingdom ..... 19127/76

[51] Int. Cl.[3] ..... H01R 43/04

[52] U.S. Cl. ..... 29/828; 29/871; 174/21 C; 174/88 C

[58] Field of Search ..... 29/628; 156/49; 174/88 C, 21 C

[56] References Cited

U.S. PATENT DOCUMENTS

| | | | |
|---|---|---|---|
| 3,566,007 | 2/1971 | O'Keefe | 29/628 X |
| 3,909,506 | 9/1975 | Campari et al. | 174/88 C |

FOREIGN PATENT DOCUMENTS

| | | |
|---|---|---|
| 2413734 | 10/1974 | Fed. Rep. of Germany . |
| 647627 | 12/1950 | United Kingdom . |
| 820899 | of 0000 | United Kingdom . |
| 880218 | of 0000 | United Kingdom . |
| 930415 | of 0000 | United Kingdom . |
| 1066560 | of 0000 | United Kingdom . |
| 1346704 | of 0000 | United Kingdom . |

*Primary Examiner*—Carl E. Hall

*Attorney, Agent, or Firm*—Lyon & Lyon

[57] ABSTRACT

An article for connecting together two substrates, for example the inner conductors of two coaxial cables to be spliced, comprises a sleeve having axially slidably mounted thereon at least one spacer, which spacer enables any member subsequently positioned around the sleeve to be spaced at a desired distance from the sleeve. The method, also described, of using the article to join substrates has the advantage that the substrates can be connected without the need to bend them substantially, so preventing damage to the substrates.

13 Claims, 6 Drawing Figures

METHOD FOR CONNECTING SUBSTRATES

This is a continuation of application Ser. No. 741,371, filed Nov. 12, 1976, now abandoned.

BACKGROUND OF THE INVENTION

This invention relates to a method of, and device for, connecting two substrates, and has especial, but not exclusive, application to connecting together the inner conductors of two coaxial telecommunication cables, each cable comprising an outer, relatively rigid tubular conductor and an inner conductor held coaxially within the outer conductor by, for example, a plurality of disk-like spacers positioned at intervals along the length of each cable, that is to say so-called "air spaced" coaxial cables.

When connecting such cables it is imperative that neither the outer conductor nor the inner conductor is distorted. Distortion of the conductor, for example kinking of the outer conductor or rendering the inner conductor and its associated outer conductor eccentric with respect to each other, tends to produce an imperfect impedance match at the connection which can result in signals carried by the cables being distorted or garbled.

It has been proposed in British patent application No. 13584/73 filed on Mar. 21, 1973 (German Offenlegungsschrift No. 24 13 734 laid open on Oct. 17, 1974), the disclosure of which is incorporated herein by reference, to connect the inner conductors of two coaxial cables using an electrically conductive member, for example a metallic sleeve, one end of which receives the inner conductor of one cable and the other end of which receives the inner conductor of the other cable. An electrical connection is then made between the sleeve and the conductors by, for example, soldering or crimping. That application also describes the use, in conjunction with the metallic sleeve, of two cap-shaped spacers, one positioned on each end of the sleeve, or in the embodiments specifically described in that application, on a heat shrinkable sleeve surrounding the metallic sleeve. These spacers ensure inter alia that the inner conductors, and the splice between them, are correctly located with respect to the electrical connection between the outer conductors. In order to install the sleeve and cap-shaped spacers around the inner conductors of the cable it is necessary for the cables to be flexible or, if cables with rigid outer conductors are to be joined, for one of the cables to be longitudinally movable so that the sleeve can be slid over the bared inner conductor of one cable without the need to bend, at least to any substantial extent, that cable, and the other cable can then be moved longitudinally until the inner conductor of that other cable is received within the sleeve. During this operation the outer conductors of the cables are received in or over their respective cap-shaped spacers. The electrical connection between the sleeve and the inner conductors can then be made.

It is often the case, however, that neither cable is longitudinally movable and, in order to use the above-described connecting sleeve, it would be necessary to kink the inner conductor of at least one of the cables, or to strip a considerable length of outer conductor from at least one of the cables. As mentioned above, kinking could produce undesirable results.

DESCRIPTION OF THE INVENTION

The present invention provides a method of, and a device for, dispensing with the need to kink the inner conductors of longitudinally immovable coaxial cables to be joined or the need to cut back the outer conductor of one of the cables to a considerable extent. At the same time, the device enables the outer conductor of the joint, which outer conductor is subsequently positioned around the inner conductor connection, to be spaced from the inner conductors at a desired distance therefrom.

According to the present invention there is provided a method of connecting two adjacent aligned substrates, wherein the connection is made by means of a device comprising a sleeve having two open ends for surrounding a part of each substrate to be connected, the sleeve having slidably mounted thereon at least one spacing means to enable any member subsequently positioned around the sleeve to be spaced from the sleeve at a desired distance therefrom, the method comprising laterally displacing one substrate relative to the other substrate to an extent sufficient to allow positioning of the sleeve and spacing means over one of the substrates, sliding substantially the whole length of the sleeve over said one substrate to an extent sufficient to allow said relatively laterally displaced substrate to return, or be returned, to a position in which it is in alignment with the other substrate, returning the relatively laterally displaced substrate, or allowing it to return, to said position, sliding the sleeve over the other substrate to such an extent that it bridges the two substrates, forming a connection between the sleeve and each substrate and, if necessary, positioning the spacing means at the desired position on the sleeve by sliding the spacing means along the sleeve. The formation of the connection may be made before or after positioning of the spacing means, if such positioning is necessary.

Preferably, the sleeve has two spacing means slidably mounted thereon, but it may have one slidable and one fixed means; the method preferably comprises positioning the sleeve with the fixed spacing means distal to the first substrate. The extent of the lateral displacement should be sufficient that the device can be positioned on one of the substrates but the displacement should not be so great that one or both of the substrates is damaged by, for example, distortion or kinking.

More especially, the present invention provides a method of connecting the inner conductors of two proximate, aligned coaxial cables the outer conductors and insulation of which cables have been stripped back to provide protruding lengths of their respective inner conductors, wherein the connection is made by a device comprising an electrically conductive sleeve having two open ends for surrounding a part of the length of each inner conductor, the sleeve having slidably mounted thereon at least one, preferably two separate, electrically insulative spacing means preferably of substantially circular cross-section to enable any tubular member subsequently positioned around the sleeve, for example an outer conductor member, to be spaced from the sleeve at a desired distance therefrom and/or to maintain the inner conductor of each cable coaxial with an associated outer conductor, which method comprises laterally displacing one cable relative to the other cable to an extent sufficient to enable the sleeve with its associated spacing means to be fitted over the inner conductor of one of the cables, sliding the sleeve and the spacing means along said inner conductor to an extent sufficient to allow the relatively laterally displaced cable to return, or be returned, to a position in which it is in alignment with the other cable, returning the relatively laterally displaced cable, or allowing it to return, to said position, sliding the sleeve over the inner conductor of the other cable to such an extent that the sleeve bridges the inner conductors, forming an electrical connection between the sleeve and the inner conductors and, if necessary, positioning the spacing means at the desired position on the sleeve by sliding the spacing means along the sleeve. The method is especially useful when at least one of the coaxial cables is air-spaced, particularly when they are both air-spaced.

The method and device of the invention are also useful where, although relative lateral movement is not needed, a limited amount of axial or longitudinal movement is needed.

Accordingly, the invention also provides a method of connecting two aligned substrates wherein the connection is made by means of a device comprising a sleeve having two open ends and having axially slidably mounted thereon at least one spacing means to enable any member subsequently positioned around the sleeve to be spaced from the sleeve at a desired distance therefrom, the method comprising positioning at least one substrate and at least part of the length of the sleeve in telescopic relationship, and sliding a part of the length of the sleeve and the other substrate into telescopic relationship, making a connection between the sleeve and the substrates and, if necessary, sliding the spacing means into its desired position on the sleeve.

The present invention also provides a device for connecting two substrates, for example the inner conductors of a pair of coaxial cables, the device comprising a sleeve having two open ends and having slidably mounted thereon at least one, preferably two separate, spacing means to enable a member subsequently positioned around the sleeve to be spaced from the sleeve at a desired distance therefrom.

In the case where the device is to be used for connecting the inner conductors of two coaxial cables, the sleeve preferably comprises a metal, for example a heat-shrinkable metal.

For connecting the inner conductors of two coaxial cables or other electrical conductors the sleeve is preferably electrically conductive, tubular and of circular cross-section and may be of tinned copper-beryllium or of copper and the electrical connections between the sleeve and the inner conductors may be in the form of solder or crimped connections. When solder connections are to be formed, the sleeve is preferably of copper. Especially in the case where a solder connection is required, (but also where a crimp connection is to be made) the electrically conductive sleeve may be in the form of an assembly comprising an inner metallic sleeve having one or more radial apertures, for example longitudinal slots one or more rings of solder surrounding the sleeve and an outer sleeve of a heat shrinkable material, the arrangement being such that, upon heating the assembly, the solder melts and the sleeve of heat shrinkable material, upon shrinking, forces the molten solder through the aperture(s) into contact with the inner conductors. Upon cooling a solder joint is formed between the conductors and the conductive sleeve.

The conductive sleeve preferably has at both ends thereof means to prevent the or each spacing means from being detached from the sleeve. Such means may also serve to enable the operator to locate the or each spacing means at an end of the sleeve. For connecting coaxial cables, in which case there are preferably two separate spacing means, such means enables the operator to locate the spacing means at respective ends of the sleeve so that the operator can clearly and accurately determine the positions of, for example, the crimp connections to be made between the sleeve and the inner conductors. The subsequently provided outer conductor may be of a form, and applied in the manner, described in German Offenlegungsschrift No. 24 13 734. The means may be provided by, for example, flaring the extremities of the sleeve to limit axial movement of the spacing means.

Each spacing means is preferably rigid, and is preferably of an electrically insulative material, for example a plastics material, for example polytetrafluoroethylene, or of glass or a ceramic material and preferably comprises two portions, one having an external diameter slightly smaller than the internal diameter of the outer conductor of the coaxial cable and another having an external diameter substantially equal to or greater than the external diameter of the outer conductor. This enables each spacer to be partly positioned within the outer conductor of its respective cable so as to maintain the inner and outer conductors coaxial and also provides means properly to locate the outer conductor of the finished connection relative to the sleeve so that the correct splice impedance is obtained. Alternatively, for example, each spacing means may comprise a cup-shaped member a part of which can be fitted over the outer conductor of a cable. Each spacing means is also preferably so shaped and sized that while being moved along the sleeve it retains a constant orientation relative to the sleeve.

For connecting coaxial cables the external diameter of the spacing means is preferably so chosen that the outer conductor of the finished connection is spaced from the sleeve at such a distance therefrom that the impedance of the splice is matched to that of the cables.

BRIEF DESCRIPTION OF THE DRAWINGS

A preferred form of device of the invention, and a method of connecting the inner conductors of two air-spaced telecommunication cables, will now be described, by way of example only, with reference to the accompanying drawings in which.

For the sake of clarity, not all of the drawings are drawn to the same scale.

DESCRIPTION OF THE PREFERRED EMBODIMENTS

Figure 1:
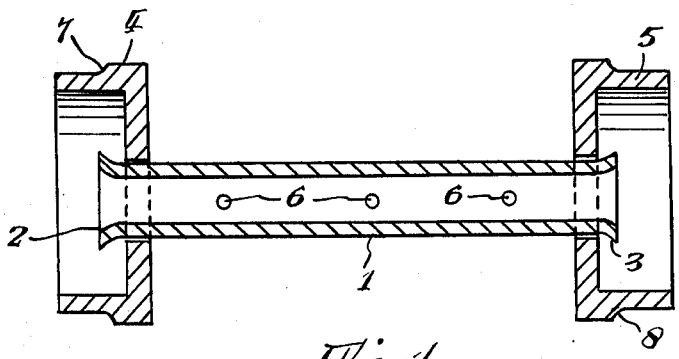
FIG. 1 is a side elevation, partly in section, of the preferred form of device.

Referring to FIG. 1, a device suitable for connecting the inner conductors of two air-spaced coaxial telecommunication cables comprises an elongate tubular metallic sleeve 1 having two open ends 2 and 3 made, for example, of tinned copper-beryllium having slidably mounted thereon a pair of cup-shaped spacers 4 and 5 made, for example of polytetrafluoroethylene. The sleeve 1 is provided with radial holes 6, which may, alternatively, be in the form of slots, to provide a visual indication of the position of the inner conductors received in the sleeve 1 and to facilitate crimping of the sleeve 1 into contact with the conductors. Each end 2 and 3 of the sleeve 1 is flared to prevent the spacers 4 and 5 from sliding off the sleeve and, in some cases, to aid in getting the correct spacing between the spacers 4 and 5. Each spacer 4, 5 comprises a cup-shaped member, the base of which is provided with an aperture having a diameter slightly greater than the external diameter of the sleeve 1 so that the spacers 4, 5 can slide along the sleeve when hard pressure (either directly or with the use of a tool e.g. pliers) is applied axially to the spacer 4 or 5 whilst maintaining the sleeve 1 spacially fixed, or vice versa. Each spacer 4, 5 has an external shoulder 7, 8 respectively which, when the spacer is in position, abuts the end of the outer conductor of its associated coaxial cable, as will be explained later.

Figure 2:
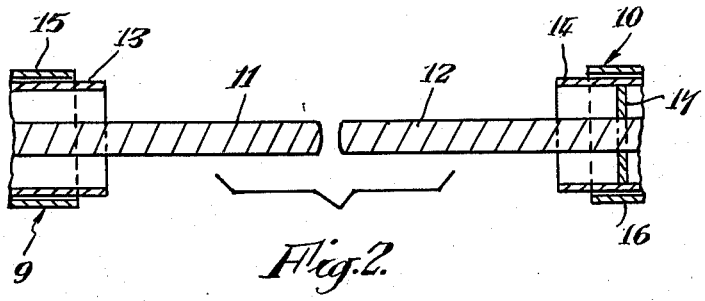
FIGS. 2 to 6 are side elevations, partly in section, showing the various steps involved in splicing two air-spaced coaxial cables using the device of FIG. 1.
Figure 3:
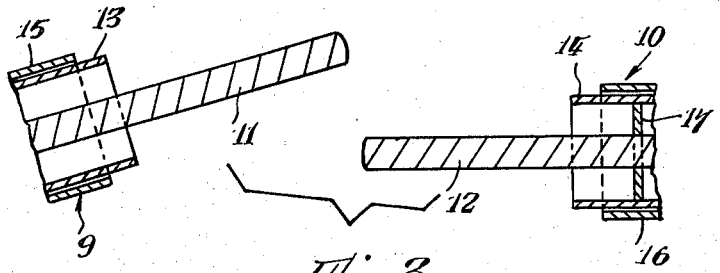
Figure 4:
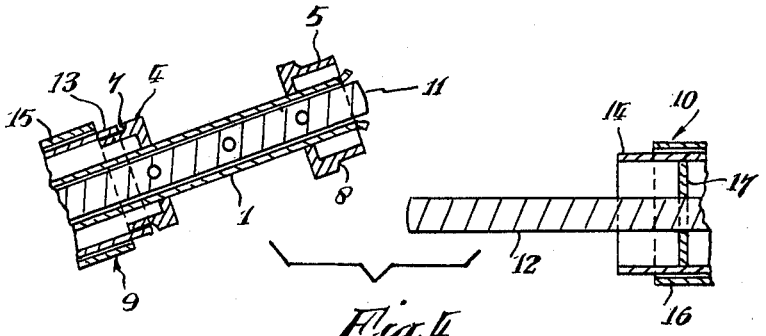
Figure 5:
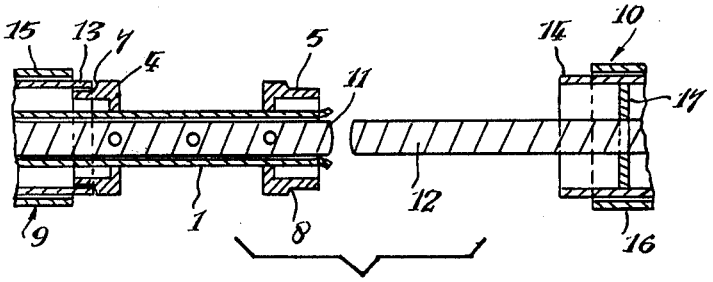
Figure 6:
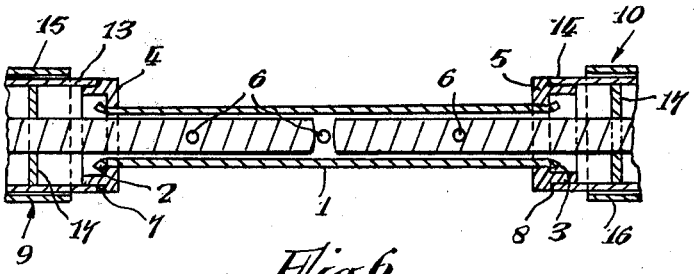

In FIG. 2 there is shown a pair of aligned coaxial cables 9 and 10 which are to be spliced. The cables 9 and 10 each comprises an inner conductor 11 and 12, respectively, an outer conductor 13 and 14 respectively (which have been cut back, for example by about 15 mm, in order to splice the cable) and an outer protective sheath 15 and 16 respectively. Each inner conductor is spaced from its outer conductor by disks 17 made of a dielectric material. In order to slide the sleeve 1 into the position shown in FIG. 5, it may be necessary to move one of the disks 17, as is shown for cable 9. As is shown in FIG. 6, the moved disk may be replaced after splicing. If, however, the dielectric between the outer and inner conductor is, for example, made of a meltable plastics material, this material may be melted to allow the sleeve 1 to be slid along the inner conductor. As can be seen the inner conductors 11, 12 of the cables 9, 10 are very close to one another. To join the conductors 10, 11, the cable 9 is displaced laterally by an amount sufficient to allow the device of FIG. 1 to be slid over the inner conductor 11 of cable 9 (see FIGS. 2 and 3). With the spacers 4 and 5 in the position shown in FIG. 1, during positioning of the sleeve 1 over the conductor 11, when the shoulder 7 of the spacer 4 comes into abutment with the outer conductor 13, continued axial movement of sleeve 1 results in relative movement between the sleeve 1 and spacer 4 and therefore, the spacer 4 has, in effect, slid along the sleeve. Axial movement of the sleeve is continued until the end 3 of sleeve 1 is coincident with the end of conductor 11 when cable 9 can be returned to its original position in alignment with cable 10 (see FIG. 4) after suitably positioning spacer 5 on the sleeve 1. Sleeve 1 is then moved axially over inner conductor 12 of cable 10 and the spacers 4 and 5, if not already in the correct positions, i.e. with shoulders 7 and 8 abutting the outer conductors 13 and 14 respectively, are slid into those positions (see FIG. 6). An electrical connection is then made between the sleeve 1 and the inner conductors 11 and 12 by crimping using a suitable tool and a splice between the outer conductors 13 and 14 may then be made. The crimped connections and outer splice are not shown in the drawings.

It will be seen from FIGS. 2 to 6 that the outer conductors 13 and 14 are cut back to such an extent that, when finally in position, the spacers 4 and 5 are positioned at the extremities of the sleeve 1 i.e. in the position shown in FIG. 1.

The connection between the coaxial cables may be completed in any of a number of ways, for example by one of the methods described in German Offenlegungsschrift No. 24 13 734.

It will be appreciated that, by providing movable spacing means, the electrically conductive sleeve may be slid along the length of the inner conductors to the desired extent since, when a spacing means abuts the outer conductor of a cable, the sleeve can be further slid along the inner conductor by virtue of its being able to slide relative to the spacing means.

It will also be appreciated that the method of the invention may be used to connect other pairs of rigid or semi rigid substrates, for example a coaxial cable to a piece of telephone equipment, and that the sleeve may be initially positioned on either of the substrates.

I claim:

1. A method of connecting the inner conductors of two proximate, aligned first and second coaxial cables, the outer conductors and insulation of said cables having been stripped back to provide protruding lengths of their respective inner conductors, comprising the steps of:

(a) laterally displacing one of said cables relative to the other of said cables;

(b) positioning on the inner conductor of the first cable a connector sleeve having at least one spacer means mounted thereon for axial sliding movement, wherein each said spacer means is formed with an outwardly facing shoulder;

(c) sliding said sleeve onto said first cable;

(d) causing said first and second cables to assume a position in which they are in alignment;

(e) moving said connector sleeve toward and over the inner conductor of said second cable to bring said connector sleeve into bridging relationship with both conductors and causing axial relative movement between the sleeve and said spacer means;

(f) making an electrical connection between said connector sleeve and both inner conductors; and (g) finally axially locating each said spacer means on the connector sleeve with their shoulders respectively in abutment with the outer conductor of said cables.

2. The method according to claim 1 wherein both said cables are air spaced coaxial cables.

3. The method according to claim 1 wherein any necessary positioning of the spacing means on said sleeve is effected before making the electrical connection.

4. The method according to claim 1 wherein said electrical connection between said connector sleeve and said inner conductors is a solder connection.

5. The method according to claim 1 wherein said electrical connection between said connector sleeve and said inner conductors is a crimp connection.

6. The method according to claim 1 wherein said connector sleeve is a metallic sleeve.

7. The method according to claim 1 wherein the said connector sleeve is of circular cross section.

8. The method according to claim 1 wherein the ends of said connector sleeve are provided with means to prevent said spacer means from becoming detached from said connector sleeve.

9. The method according to claim 8 wherein said ends of said connector sleeve are flaired to prevent said spacer means from becoming detached from said connector sleeve.

10. The method according to claim 1 wherein the or a wall of said connector sleeve has one or more apertures therein.

11. The method according to claim 1 wherein each spacer means comprises a generally cup shaped member the open end of said member facing outwardly.

12. The method according to claim 1 wherein each spacer means comprises a material selected from the group consisting of polytetrafluoroethylene, glass or a ceramic material.

13. The method according to claim 1 which further comprises subsequently positioning around said electrical connection between said inner conductors an outer conductor member and making an electrical connection between the outer conductor of said coaxial cables.

* * * * *